US005297679A

United States Patent [19]

Rondone et al.

[11] Patent Number: 5,297,679

[45] Date of Patent: Mar. 29, 1994

[54] BLISTER PACKAGE AND STORAGE DEVICE

[75] Inventors: Sam Rondone, La Mirada; John T. Franck, Jr., La Habra Heights, both of Calif.

[73] Assignee: House of Packaging, Inc., City of Industry, Calif.

[21] Appl. No.: 34,437

[22] Filed: Mar. 19, 1993

[51] Int. Cl.[5] ..... B65D 73/00

[52] U.S. Cl. ..... 206/468; 206/461; 206/467

[58] Field of Search ..... 206/45.34, 468, 467, 206/462, 532, 461

[56] References Cited

U.S. PATENT DOCUMENTS

| | | | |
|---|---|---|---|
| 3,104,759 | 9/1963 | Hansen | 206/78 |
| 3,303,930 | 2/1967 | Hyland | 206/462 |
| 3,326,370 | 6/1967 | Riestenberg | 206/78 |
| 3,382,972 | 5/1968 | Phipps | 206/468 |
| 3,414,159 | 12/1968 | Murr | 220/41 |
| 3,464,544 | 9/1969 | Franck | 206/468 |
| 3,467,248 | 9/1969 | Makowicki | 206/462 |
| 3,530,978 | 9/1970 | Lewandowski | 206/468 |
| 3,610,410 | 10/1971 | Seeley | 206/532 |
| 3,937,326 | 2/1976 | Schick | 206/465 |
| 4,133,429 | 1/1979 | Kuchenbecker | 206/468 |
| 4,437,566 | 3/1984 | Szahler | 206/467 |

FOREIGN PATENT DOCUMENTS

| | | | |
|---|---|---|---|
| 1053616 | 5/1979 | Canada . | |
| 1225809 | 2/1960 | France . | |
| 1298413 | 6/1962 | France | 206/468 |
| 1574108 | 7/1969 | France | 206/468 |
| 1309691 | 3/1973 | United Kingdom . | |

*Primary Examiner*—David T. Fidei

*Attorney, Agent, or Firm*—Townsend and Townsend Khourie and Crew

[57] ABSTRACT

A blister package for containing a product has a tub and a base. The tub slidably engages the base and is slidable between a storage position, used for storing the product, and a removal position, used for removing the product. A panel is secured to the base and locks the tub in the storage position until removed. After the panel is removed, the tub is free to slide to the removal position in which a part of an open side of the tub is adjacent an access aperture in the base. A cover covers the access aperture and is movable between a closed position, adjacent the access aperture, and a open position, spaced apart from the access aperture.

14 Claims, 3 Drawing Sheets

BLISTER PACKAGE AND STORAGE DEVICE

BACKGROUND OF THE INVENTION

The present invention relates to the field of blister packages. Blister packages include a tub for containing a product and a cardboard backing. The tub is typically made of clear plastic so that the product can be seen.

In many conventional blister packages the tub is glued to the cardboard backing. The blister package is opened by tearing the cardboard away from the plastic tub. A problem with conventional glued blister tubs is that once the package is opened it cannot be resealed. If items are kept in an opened blister package they are prone to fall out and become lost.

Several known blister packages have a tub which is slidable relative to the backing so that after the blister package is first opened it can be closed again and used to contain the remaining product. A slidable blister tub is disclosed in U.S. Pat. No. 3,467,248 to Mackowicki. The tub has laterally protruding flanges which engage a pair of channels. To remove the product, a user slides the tub so that the tub opening is beyond the cardboard backing. After the desired items are removed, the tub is moved back to store the remaining product.

A problem with the blister package disclosed in U.S. Pat. No. 3,467,248 is that the tub is not restrained from sliding. The blister package can be opened quickly and presents an easy target for thieves.

A further problem with the blister package disclosed in U.S. Pat. No. 3,467,248 is that the tub can become completely disengaged from the cardboard backing. If the tub becomes inadvertently disengaged from the cardboard backing some of the product will probably be spilled. The tub can become disengaged when a user is removing items and inadvertently slides the tub beyond the flange to channel engagement. The tub can also become disengaged during transportation since the tub is not restrained from sliding.

A further problem with the blister tub disclosed in U.S. Pat. No. 3,467,248 is that a user cannot tell whether the blister package has already been opened. Consumers often want to know whether a package has been opened, particularly with edible items, to avoid products which have been tampered with.

SUMMARY OF THE INVENTION

The present invention overcomes the problems with known blister packages. The blister package of the present invention has a slidable tub and a base. The slidable tub advantageously permits storage of the product in the blister package after the blister package has been opened. The base has an access aperture through which items can be removed.

The tub has a container forming a concavity for holding the product. The tub also has an open side for removing the product. Two substantially parallel flanges extend laterally from the open side.

The base has two spaced-apart, substantially parallel tracks shaped to slidably engage the tub flanges. The slidable engagement between the flanges and the parallel tracks permits the tub to slide relative to the base between two terminal positions. The storage position is used for storing the product and the removal position is used for removing the product.

The base also includes a tub opening sized to receive the container of the tub. An access aperture, through which product is removed, is also formed in the base.

The access aperture is located to be in direct communication with the concavity when the tub is in the removal position so that product can be removed through the aperture.

A cover is provided for covering the access aperture. The cover is hingedly attached to the base and movable between a closed position, covering the access aperture, and a open position, spaced apart from the access aperture. The cover advantageously prevents items from inadvertently falling out of the blister package when the tub is in the removal position.

The blister package also includes a locking mechanism, removably attached to the base, for retaining the tub in the storage position. The locking mechanism may include a seal constructed to indicate when the locking mechanism has been removed. The locking mechanism and seal advantageously indicate whether the blister package has already been opened. Preferably, the locking mechanism is a removable portion connected to the base and extending between the two tracks.

A limiting device prevents sliding of the tub beyond the two terminal positions. The limiting device advantageously ensures that the tub cannot become disengaged from the base. Preferably, an upper side and a bottom edge of the tub opening form the upper and lower restraints.

Other features and advantages of the invention will appear from the following description in which the preferred embodiment has been set forth in detail in conjunction with the accompanying drawings.

DESCRIPTION OF THE PREFERRED EMBODIMENT

Figure 3:
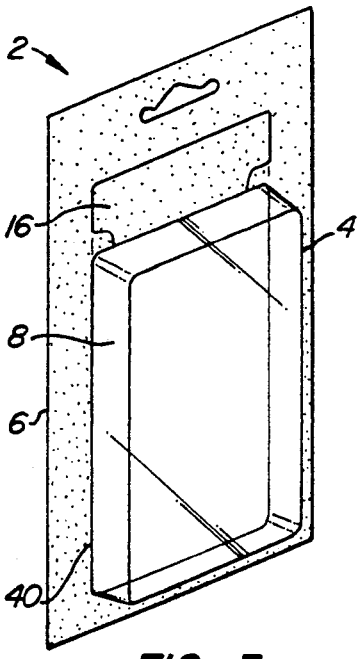
FIG. 3 is a perspective view of a blister package with a locking cardboard piece in place.

A blister package 2 including a preferably transparent tub 4 and a base 6 is shown in FIG. 3. The blister package 2 is used for presenting a product (not shown) for sale. The tub 4 is slidable relative to base 6 to advantageously permit storing the product in the blister package 2 after the blister package 2 has been opened.

Figure 2:
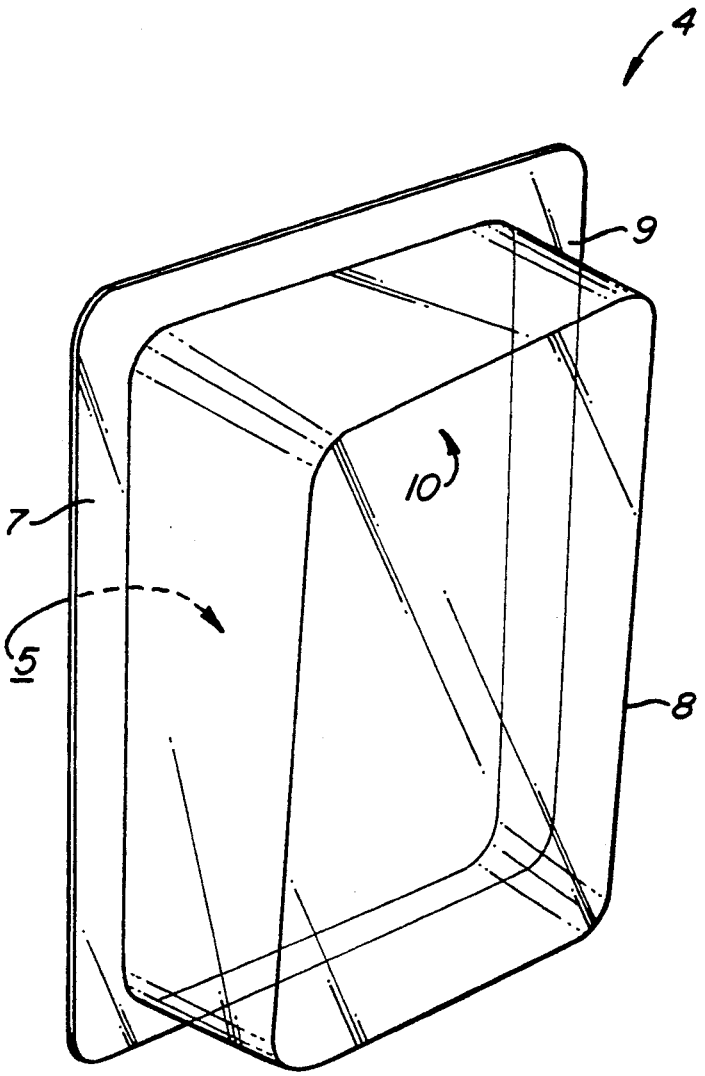
FIG. 2 is a perspective view of a tub.

The tub 4 includes a container 8 forming a concavity 10 for containing the product (FIG. 2). The tub 4 also has an open side 5 for removing product from the container 8. A pair of substantially parallel flanges 7, 9 extend laterally from the container 8 and lie in the plane of the open side 5. The pair of substantially parallel flanges 7, 9 engage the base 6 in a manner so that the two can slide relative to each other as is described below. The tub 4 is preferably made of a clear plastic material so that the product may be seen.

Figure 1:
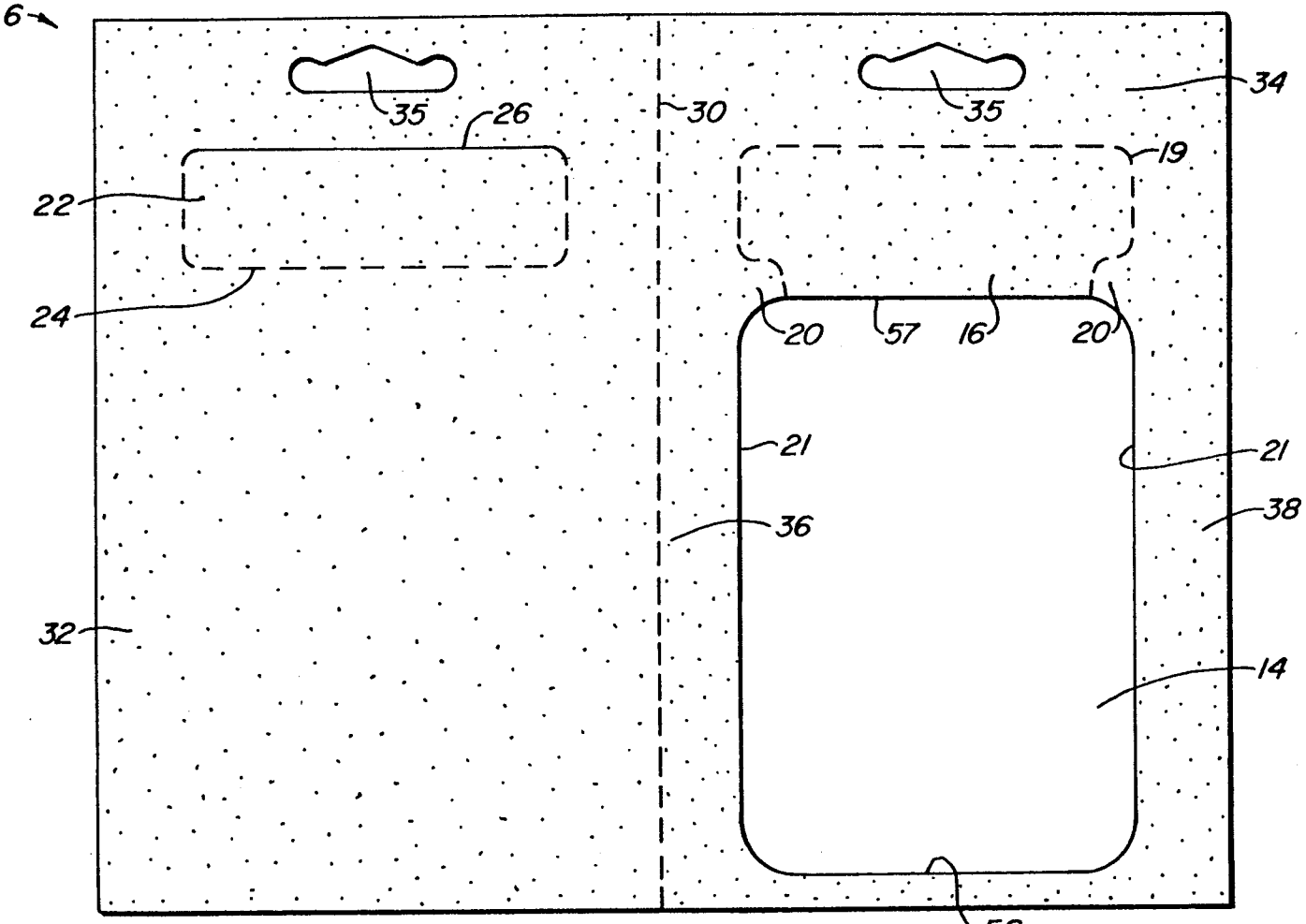
FIG. 1 is a plan view of a base cut from a cardboard sheet.

Base 6 is formed from a single sheet of material, preferably cardboard (FIG. 1). The sheet of material is scored lengthwise along a center score line 30 to form two sheet sections 32, 34 which can be folded together so that their peripheries are aligned.

The right-hand (as seen in FIG. 1) sheet section 34 includes a large cutout or opening 14 bordered by a lower edge 56, lateral sides 21, and an upper edge 57. Cutout 14 is dimensioned so that the container portion 8 of the tub 4 can protrude therethrough. The upper edge 57 is part of a panel 16 bordered by a perforation line 19. In one embodiment of the invention, the lateral portions of the perforation line 19 are a continuation of the lateral cutout sides 21. Alternatively, score line 19 is indented, as shown in FIG. 1, to define tabs 20, the purpose and functioning of which is described later.

Left-hand sheet section 32 includes an openable closable cover 22 bordered by a generally U-shaped, perforated line 24 and a score line 26. In use, the cover can be pushed out, by separating it from the remainder of the sheet along perforation line 24, so that the cover is hingeable about score line 26 between a closed position, in which the cover is in the plane of sheet 32, and an open position in which it extends angularly away from the sheet. For purposes further described below, cover 22 in left-hand sheet section 32 is in substantial alignment with panel 18 in right-hand sheet section 34 when the two sheets are folded together.

Each sheet section 32, 34 further includes a cutout 35 which is positioned so that they are aligned when the sheets 32, 34 are folded together and which are used for hanging the blister package from suitable hangers (not shown).

Figure 5:
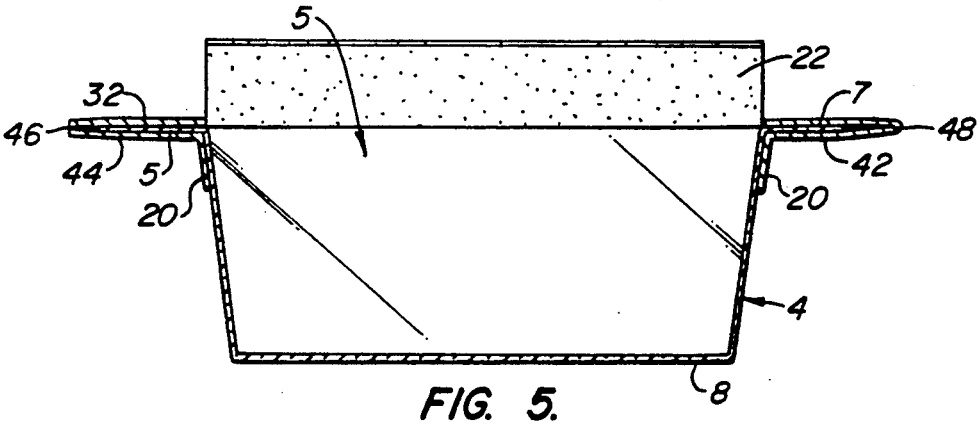
FIG. 5 is a cross-sectional view of the blister package.

When the two sheet sections are folded together, they define parallel, longitudinally extending tracks 46, 48 in the form of narrow slits or gaps between the two sheets, as is best illustrated in FIG. 5. Tub 4 is placed between the sheet sections so that container 8 protrudes through opening 14 and the lateral flanges 7, 9 are captured in the tracks defined by the overlapping portions of the sheet sections.

To complete the package, the two sheet sections are secured; e.g. glued, bonded, welded, stapled, riveted or the like, to each other along the three non-joined, peripheral edges of the two sheet sections, care being taken that the tracks which receive the lateral flanges of the tub are not obstructed. To free the tub 4, perforated connection 18 is broken and panel 16 is removed. With the panel 16 in place access to container portion is prevented and provides indication that the blister package has not previously been opened.

Figure 4:
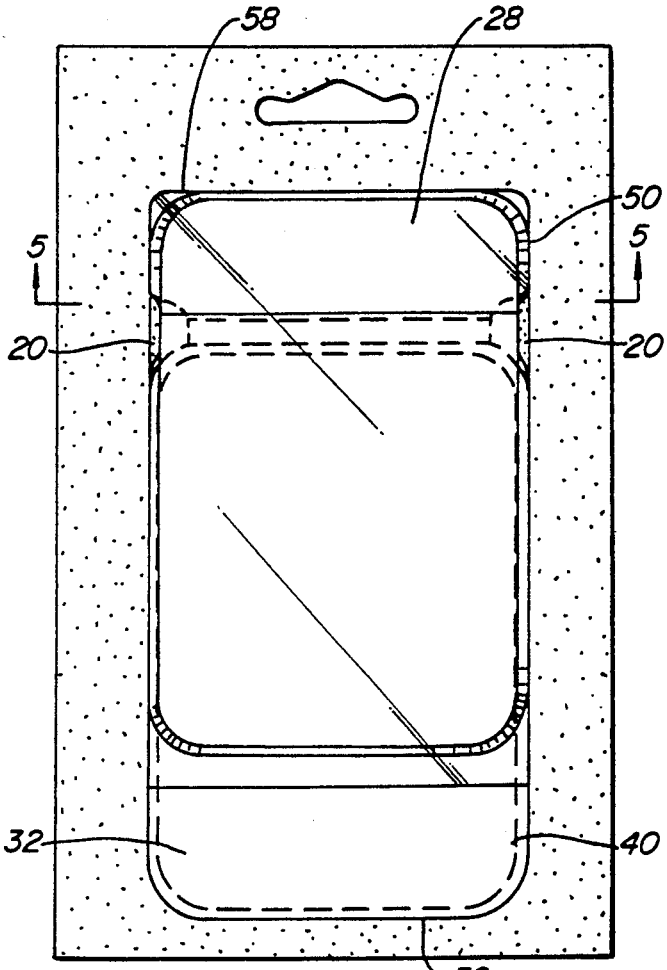
FIG. 4 is the blister package with the locking cardboard piece removed and the tub positioned for removing the product.

FIG. 4 shows blister package 2 with the tub 4 positioned in a removal position. A storage position, which is used for storing the product, is shown with broken lines. The removal position 50 permits removal of the product through an access aperture 28. Once perforated connection 24 is broken, cover 22 is released and movable between the closed position, and the open position. FIG. 5 shows cover 22 in the open position permitting removal of the product through access aperture 28.

After removing the desired quantity of the product from the container 8 through the access aperture 28, the tub 4 is moved back to storage position for storing the remaining product. Tabs 20 help to keep the tub 4 in the storage position after the panel 16 is removed. Tabs 20 are sized to bend and when a user applies a modest amount of force to tub 4. FIG. 4 shows tabs 20 bent when tub 4 is in the removal position.

Tub 4 is restrained from sliding beyond the storing and removal positions 40, 50 by the lower edge 56 of opening 14 defined by sheet 34 and the upper side 58 formed by the same sheet as panel 16. Bottom edge 56 and upper side 58 prevent the tub 4 from becoming disengaged from the base 6 unless it is distorted, broken, or torn. Inadvertent spilling of the product is thereby avoided.

Modification and variation can be made to the disclosed embodiments without departing from the subject of the invention as defined by the following claims. For example, base 6 made be made from two sheets rather than one, second sheet 34 can be stapled to first sheet rather than glued, or cover 22 can be slidably mounted to base 6 rather than being hingedly connected thereto.

What is claimed is:

1. A blister package for storing and dispensing a product comprising:

a tub forming a concavity for holding the product and having an open side, and first and second, substantially parallel flanges extending laterally from the open side of the tub;

a base for placing over and closing the open side of the tub to thereby retain the product in the package, the base comprising;

track means defining spaced-apart, substantially parallel tracks shaped to slidably engage the flanges so that the tub and the base can be moved relative to each other along the tracks, means limiting relative slidable movements of the tub between storage and removal positions of the tub, and an access aperture located to be in direct communication with the concavity when the tub is in the removal position so that product can be removed from the package through the aperture; and a cover attached to the base, closing the aperture and being selectively movable relative to the base for opening the aperture;

whereby the product can be dispensed from the package upon moving the cover to open the aperture and positioning the tub in the removal position, and whereby the product is retained within the tub when the tub is in the storage position.

2. A blister package according to claim 1 further comprising means for hingeably attaching the cover to the base so that the aperture can be opened and closed by hingeably moving the cover relative to the base.

3. A blister package according to claim 2 further comprising locking means removably attached to the base for retaining the tub in the closed position for preventing slidable movement of the tub relative to the base while the locking means is in place.

4. A blister package for storing and dispensing a product comprising:

a tub forming a concavity for holding the product and having an open side, and first and second, substantially parallel flanges extending laterally from the open side of the tub;

a base for placing over and closing the open side of the tub to thereby retain the product in the package, the base being constructed of cardboard, the base comprising;

track means defining spaced-apart, substantially parallel tracks shaped to slidably engage the flanges so that the tub and the base can be moved relative to each other along the tracks, means limiting relative slidable movement of the tub between storage and removal positions of the tube, and an access aperture located to be in direct communication with the concavity when the tub is in the removal position so that product can be removed from the package through the aperture;

a cover attached to the base, closing the aperture and being selectively movable relative to the base for opening the aperture;

means for hingeably attaching the cover to the base so that the aperture can be opened and closed by hingeably moving the cover relative to the base; and locking means removably attached to the base for retaining the tub in the closed position for preventing slidable movement of the tub relative to the base while the locking means is in place, the locking means comprising a cardboard portion connected to and extending between the track means and located on a side of the tub flanges facing away from the open side of the tub, the locking means being formed so that it can be detached from the track defining means for permitting slidable movement of the tub from the closed position to the open position;

whereby the product can be dispensed from the package upon moving the cover to open the aperture and positioning the tub in the removal position, and whereby the product is retained within the tub when the tub is in the storage position.

5. A blister package for storing and dispensing a product comprising:

a base including first and second, substantially flat sheets secured to each other along margins of the sheet, the first sheet being substantially continuous and the second sheet including an elongated cutout defined by at least a pair of substantially parallel cutout edges which are spaced from the margins so that the sheets define between them first and second, parallel tracks;

a tub forming a concavity for holding the product, the concavity being shaped so that it fits inside the elongated cutout and protrudes therefrom, the tub having an open side with flanges laterally extending therefrom, the flanges being shaped and positioned for engaging the tracks, the concavity having a length less than the length of the elongated cutout to permit relative slidable movements of the tub along the tracks between first and removal positions; and means, carried by the first sheet, for selectively providing access to an interior of the concavity when the tub is in the removal position for the removal of product from the package, whereby product cannot be removed from the package when the tub is in the storage position.

6. A blister package according to claim 5 further comprising means for locking the tub in the storage position to prevent access to the concavity through the opening.

7. A blister package for storing and dispensing a product comprising:

a base including first and second, substantially flat sheets secured to each other along margins of the sheet, the first sheet being substantially continuous and the second sheet including an elongated cutout defined by at least a pair of substantially parallel cutout edges which are spaced from the margins so that the sheets define between them first and second, parallel tracks;

a tub forming a concavity for holding the product, the concavity being shaped so that it fits inside the elongated cutout and protrudes therefrom, the tub having an open side with flanges laterally extending therefrom, the flanges being shaped and positioned for engaging the tracks, the concavity having a length less than the length of the elongated cutout to permit relative slidable movements of the tub along the tracks between first and removal positions;

means, carried by the first sheet, for selectively providing access to an interior of the concavity when the tub is in the removal position for the removal of product from the package, whereby product cannot be removed from the package when the tub is in the storage position; and means for locking the tub in the storage position to prevent access to the concavity through the opening, the locking means being removably attached to the base and including seal means constructed to permanently indicate when the locking means has been removed from the base.

8. A blister package according to claim 7 wherein the seal means is defined by a breakable, non-replaceable connection between the base and the locking means.

9. A blister package for storing and dispensing a product comprising:

a base including first and second lateral edges extending between an upper edge and a lower edge, a back panel having a sealing portion, an access aperture positioned between the upper edge and the sealing portion and being sized to permit the items to pass therethrough, a first track positioned along a portion of the first lateral edge, and a second track positioned along a portion of the second lateral edge;

a tube including a container sized to fit between the first and second tracks, an open side through which the product is removed, and first and second flanges extending laterally from the open side, the first and second flanges being positioned in the first and second tracks respectively so that the tub is slidably coupled to the base, the tub being slidable relative to the base between a storage position where the open side is adjacent the sealing portion so that the product is retained inside the container, and a removal position, where a part of the open side is adjacent the access aperture so that the product can be removed from the container; and locking means for retaining the tub in the storage position and preventing slidable movement of the tub from the storage position while the locking means is in place.

10. The blister package and storage device of claim 9 wherein the locking means is a removable portion removably secured to the base between the tub and the upper body edge.

11. The blister package and storage device of claim 9 further comprising a cover sized to substantially cover the opening, the cover being movable between a closed position substantially covering the access aperture and a open position spaced apart from the access aperture.

12. A blister package and storage device for a product comprising:

a base including first and second lateral edges extending between an upper edge and a lower edge, a back panel having a sealing portion, an access aperture positioned between the upper edge and the sealing portion and being sized to permit the product to pass therethrough, a first track positioned along a portion of the first lateral body edge, and a second track positioned along a portion of the second lateral body edge;

a cover sized to cover the access aperture and being movable between a closed position substantially covering the access aperture and a open position spaced apart from the access aperture; and a tub including a container sized to fit between the first and second tracks, an open side through which the product is removed, and first and second flanges extending laterally from the open side, the first and second flanges being positioned in the first and second tracks, respectively, so that the tub is slidably coupled to the base, the tub being slidable relative to storage position, where the open side is adjacent the sealing portion so that the product cannot inadvertently fall out, and a removal position, where a part of the open side is adjacent the access aperture so that the product can be removed.

13. The blister package and storage device of claim 12 further comprising means for locking the tub from sliding to the removal position.

14. The blister package and storage device of claim 13 wherein the locking means is a removable portion removably secured to the base between a part of the tub and the upper edge.

* * * * *